United States Patent [19]

Maki

[11] Patent Number: 4,779,535

[45] Date of Patent: Oct. 25, 1988

[54] SLUG ASSEMBLY FOR SHOTGUN SHOTSHELL

[76] Inventor: Nagatoshi Maki, 2-48-4, Kamiishihara, Chofu-shi, Tokyo, Japan

[21] Appl. No.: 109,267

[22] Filed: Oct. 16, 1987

[51] Int. Cl.[4] ..... F42B 5/24; F42B 11/00; F42B 13/00

[52] U.S. Cl. ..... 102/501; 86/28; 86/39; 102/448; 102/517; 102/439

[58] Field of Search ..... 102/501, 448, 525, 520, 102/521, 517–519, 532, 524, 525, 430, 439, 513; 244/3.23; 86/28, 39

[56] References Cited

U.S. PATENT DOCUMENTS

| | | | |
|---|---|---|---|
| 13,679 | 7/1861 | Hotchkiss | 102/525 |
| 34,493 | 2/1862 | Havens | 102/525 |
| 40,153 | 10/1863 | Billings | 102/525 |
| 43,615 | 7/1864 | Williams | 102/525 |
| 3,058,420 | 10/1962 | Tanner et al. | 102/527 |
| 3,394,905 | 7/1968 | Rapp | 102/525 |
| 3,613,584 | 10/1971 | Hendricks | 102/525 |
| 4,301,733 | 11/1981 | Blanco | 102/513 |
| 4,471,699 | 9/1984 | Turco et al. | 102/501 |
| 4,587,905 | 5/1986 | Maki | 102/430 |
| 4,610,205 | 9/1986 | Bentley | 102/529 |
| 4,700,630 | 10/1987 | Sullivan | 102/439 |

FOREIGN PATENT DOCUMENTS

| | | |
|---|---|---|
| 57-23800 | 2/1982 | Japan . |
| 58-181199 | 12/1983 | Japan . |
| 60-39671 | 11/1985 | Japan . |

OTHER PUBLICATIONS

Journal of Technical Disclosure No. 87-10881, published on Sep. 21, 1987 in Japan.

*Primary Examiner*—Howard J. Locker
*Attorney, Agent, or Firm*—Michael N. Meller

[57] ABSTRACT

A slug assembly for a shotgun shotshell having a case in which the slug assembly is incorporated, comprising a metal slug having a center axial cavity, an elastically deformable stabilizer which is fitted in the cavity, and a filler which is charged in the cavity. The stabilizer has a plunger having a diameter larger than a diameter of the opening of the cavity of the slug and an annular flange having a diameter substantially identical to a diameter of a barrel bore of a shotgun in which the slug assembly is to be used. The plunger and annular flange are coaxial to each other. The plunger cooperates with the cavity of the slug to maintain a distance between a rear end face of the slug and a front end face of the annular flange of the stabilizer at a predetermined value.

4 Claims, 2 Drawing Sheets

SLUG ASSEMBLY FOR SHOTGUN SHOTSHELL

BACKGROUND OF THE INVENTION

1. Field of the Invention

The present invention relates to a slug assembly for a shotgun shotshell.

2. Description of the Related Art

A projectile such as a slug used with a shotgun has a lower hit probability than that of a rifle bullet, and this is due to a deformation of the slug during passage thereof through the barrel bore, which causes a deviation of the slug from the line of the sight, i.e., the axis of the barrel bore, as will be apparent hereinafter.

SUMMARY OF THE INVENTION

The primary object of the present invention is, therefore, to provide a slug assembly having an improved hit probability by preventing the above deformation of the slug, and thus resultant deviation from the line of sight by the slug, and further, to improve the stability of a flight posture of the slug by providing a stabilizer according to the present invention.

To achieve the above object, according to the present invention, there is provided a slug assembly for a shotgun shotshell having a case with an opening, a powder, wad or wads and the slug assembly being charged, in this order, in the case, and the opening of the case being crimped, wherein the slug assembly comprises a metal slug, an elastically deformable stabilizer, and a filler, and the slug is provided with a center axial cavity opening at the rear end of the slug. The stabilizer is provided with a plunger, a portion of which has a diameter larger than a diameter of the rear opening of the cavity of the slug and an annular flange thereof has a diameter substantially identical to a diameter of a barrel bore of a shotgun in which the shotshell is to be used. The plunger and the annular flange are arranged coaxially to each other, and the plunger is provided with a positioning means defined by the plunger and the cavity of the slug for maintaining a distance between a rear end face of the slug and a front end face of the annular flange of the stabilizer at a predetermined value. A predetermined amount of the filler is charged in the cavity of the slug, and the stabilizer is fitted into the cavity of the slug so that the opening of the cavity is closed by the positioning means.

BRIEF DESCRIPTION OF THE DRAWINGS

The invention will be described below in detail with reference to the accompanying drawings, in which.

DESCRIPTION OF THE PREFERRED EMBODIMENTS

Figure 8:
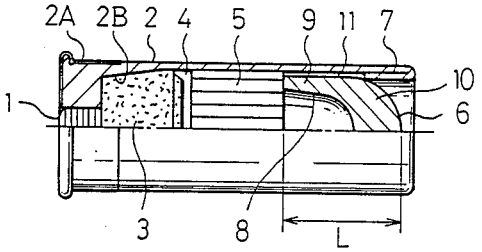
FIG. 8 is a partial longitudinal sectional view of a known shotshell.

FIG. 8 shows a known shotshell having a slug loaded therein. In FIG. 8, a powder 3, an overpowder wad 4, a filler wad 5, and a slug 6 are charged, in this order, in a case 2 having a primer 1 and a base metal 2A at one end thereof. The slug 6 is held in the case 2 by a curling crimp 7 of the case 2. The slug 6, which is well known in the market, has a semispherical head 10 and a cylindrical body 9 integral therewith and having a cavity 8.

The inner diameter of the case 2 is substantially identical to a diameter D of a barrel bore 50 (FIG. 9) of a shotgun in which it is to be used. The outer diameter of the cylindrical body 9 is smaller than the inner diameter of the case 2, and accordingly, there is a gap 11 between the case 2 and the cylindrical body 9 of the slug 6.

Figure 9:
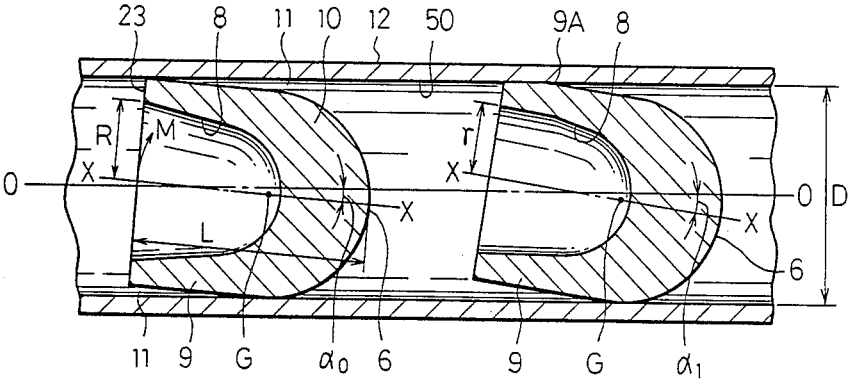
FIG. 9 is a schematic view showing an inclination of a slug in the prior art.

When the powder 3 is exploded, the slug 6 is moved forward by the overpowder wad 4 and the filler wad 5, so that the crimp 7 is destroyed by the slug 6, and as a result, the slug 6 can move forward in the barrel bore 50 (FIG. 9). If the slug 6 is inclined when ejected from the case 2, because of, for example, an irregular uncurling of the crimp 7 or an inclination of the end face of the filler wad 5, etc., inclination of the slug 6 can occur due to the existence of the gap 11. Namely, as can be seen from FIG. 9, the axis X—X of the slug 6 is inclined by $\alpha_0$ with respect to the center axis 0—0 of the barrel bore 50. This inclination causes a deviation of the center G of gravity of the slug 6 from the center axis 0—0 of the barrel bore 50. In addition, since the rear end face 23 of the slug 6 is subject to a high peak pressure of about 9000 to 10500 lbs/in$^2$, a large moment M in the clockwise direction is produced in an example shown in FIG. 9.

A conventional slug 6 is usually made of a high purity lead, and accordingly, has a relatively small tensile strength and rigidity, which will allow a deformation of the slug 6 as shown in FIG. 9. In FIG. 9, the slug 6 is shown in two positions during course of travel of the slug 6 in the barrel bore 50, and the inclination of the slug 6 causes a buckling of the body 9 at the portion designated 9A, as shown by the slug on the right of the Figure. The buckled portion of the slug 6 has a decreased radius r which is smaller than the original radius R of the slug 6. Namely, the open end of the cavity 8 is partially contracted. This buckling of the slug 6 also increases the inclination of the slug 6 in the barrel bore 50. Namely, the inclination $\alpha_0$ becomes a larger value of $\alpha_1$. It is easily understood that the buckling of the slug 6 will increase during the travel thereof in the barrel 12, and accordingly, the slug 6 will be deformed so that it is asymmetric to its own axis X—X. Consequently, the slug 6 is inclined when fired from the muzzle of the barrel 12. After leaving the muzzle of the barrel 12, the inclination of the slug 6 causes an undesirable lift thereof due to the action of wind and air resistance thereon, and thus the slug 6 is deviated from the line of the sight, resulting in a low hit probability.

The present invention is aimed at the elimination of the deformation and resultant inclination of the slug during the passage of the slug through the barrel of a shotgun, and at a realization of a stable posture of the slug with the use of a stabilizer.

The slug assembly of the present invention essentially comprises a slug 6 which per se is available on the market and which has an open cavity 8 at the rear end thereof in which a predetermined amount of filler 22 (FIG. 3) is charged, and a stabilizer 13 (FIG. 2) which is attached to the opening of the cavity 8.

Figure 1:
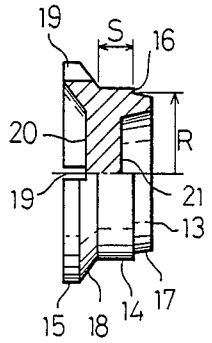
FIG. 1 is a partial sectional view of a stabilizer according to the present invention.
Figure 2:
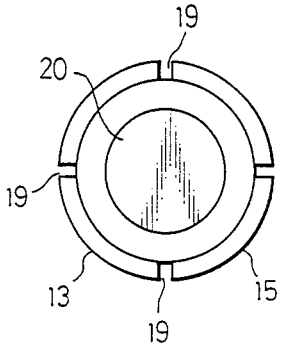
FIG. 2 is a rear view of the stabilizer shown in FIG. 1.

FIGS. 1 and 2 show an embodiment of a stabilizer according to the present invention.

The stabilizer 13 is made of a material having a good rigidity and elasticity, such as plastics or the like, and is provided with a plunger 14 having a radius larger than the radius R of the opening of the cavity 8 (FIG. 9) of the slug 6, and an annular flange 15 integral therewith and coaxial thereto. The plunger 14 is cylindrical and has a stepped portion 16 and a truncated conical projection 17, the bottom of which has a radius substantially equal to the radius R mentioned above and is coaxial to the stepped portion 16. The truncated conical projection 17 is connected to the cylindrical plunger body 14 through the stepped portion 16. The annular flange 15 has an outer diameter substantially equal to the inner diameter D of the barrel bore 50, and is connected to the plunger 14 by a tapered portion 18. A plurality of slits 19 are provided on the outer periphery of the flange 15, which extend in the axial direction. The flange 15 is provided, at the rear end face thereof, with a center recess 20. The plunger 14 also has a center recess 21 on the end face thereof, remote from the recess 20 of the flange 15. The recess 21 is used to increase the amount of filler 22 (FIG. 3) to be charged in the cavity 8 of the slug 6.

Figure 3:
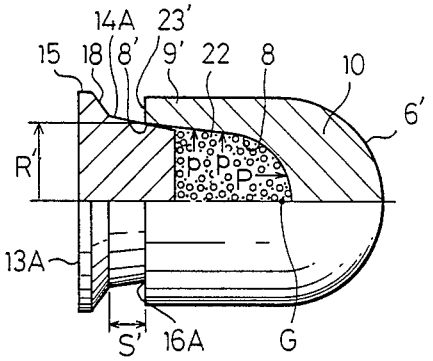
FIG. 3 is a partial longitudinal sectional view of a slug assembly according to one aspect of the present invention.

FIG. 3 shows a slug assembly having a stabilizer 13A, which is slightly different from the stabilizer 13 shown in FIGS. 1 and 2, according to the present invention, and a slug 6' per se available on the market. The stabilizer 13A is provided with a plunger 14A in the form of a truncated cone without a step and having a bottom with a radius thereof which is larger than the radius R' of the cavity opening 8' of the cavity 8 of the slug 6. The radius of the front end of the plunger 14A is smaller than the radius R' mentioned above. In the embodiment shown in FIG. 3, the stabilizer 13A is not provided with the slit 19, recess 20, and recess 21 shown in FIGS. 1 and 2, but the remaining construction of the stabilizer 13A is the same as that of the stabilizer 13.

The filler 22 charged in the cavity 8 of the slug 6 or 6' is composed of fine particles, grains, or powders of plastics, rubber or cork, having a proper hardness and elasticity which is determined by experiment.

In a second embodiment shown in FIG. 3, a predetermined amount of filler 22 is charged in the cavity 8 of the slug 6', and then the stabilizer 13A is inserted in the slug 6' so that the portion 16A of the truncated conical plunger 14A having a radius identical to the radius R' of the cavity opening 8' of the cavity 8 comes into contact with the inner peripheral surface of the cavity opening 8'. When the stabilizer 13A and the slug 6' are assembled, there is a gap s' between the flange 15 and the rear end face 23' of the slug 6'; more precisely, between the connection between the tapered portion 18 of the flange 15 and the plunger 14A and the rear end face 23' of the slug 6'.

Note that the gap s' in FIG. 3 replaces the gap in the first embodiment shown in FIGS. 1 and 2, in which the stepped portion 16 of the plunger 14 serves as a position restricting means which comes into contact with the rear end face 23' of the slug 6' when the stabilizer 13 is inserted in the slug 6'. The gap s in FIG. 1 corresponds to a length of the cylindrical body of the plunger 14.

The resultant slug assembly of this embodiment of the present invention is then charged in the case 2 (FIG. 8) to complete the shotshell assembly, instead of the slug 6 shown in FIG. 8.

The above slug assembly according to the present invention operates as follows.

When the slug assembly is moved through the barrel bore 50 by the pressure caused by exploding the charge in the case 2, after destroying the crimp 7, this explosion pressure forces the plunger 14 (14A) into the cavity 8 of the slug 6 (6') and thus expands the cavity opening 8' of the cavity 8. Namely, the filler 22 charged in the cavity 8 is compressed by the stabilizer 13 (13A), causing the formation of an internal pressure as a result of a reaction pressure in the cavity 8, and this internal pressure in the cavity 8 causes an expansion of the cavity 8.

Among the components of this internal pressure, the component P acting in the axial direction is larger than the component p acting in the radial direction. Namely, the radial pressure component p can be produced by a radial displacement of the adjacent grains of the filler 22 which rub against each other and produce a frictional resistance therebetween. Conversely, the axial pressure component P can be produced only by a deformation of the grains or particles of the filler 22, and produces an extremely low frictional resistance.

Figure 4:
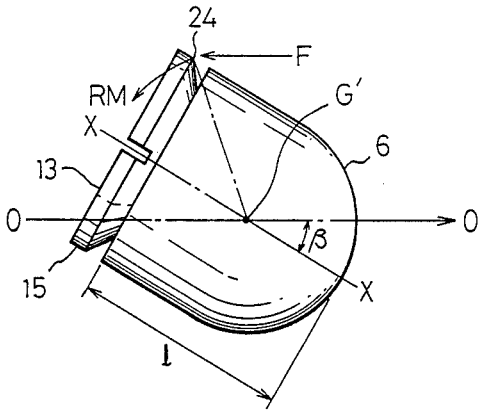
FIG. 4 is a schematic view of a slug assembly shown in FIG. 3, for explaining how a slug assembly which has been inclined is restored to the initial posture thereof according to the present invention.

Since a large part of the mass of the slug 6 (6') is comprised of the head 10 of the slug 6 (6'), deformation of the slug 6 (6') occurs during the passage of the slug 6 (6') in the barrel bore 50 at a rapidly accelerated speed, so that the initial axial length L (FIG. 9) of the slug 6 (6') is decreased to a length l as shown in FIG. 4, due to inertial resistance. At this time, the internal axial pressure component P mentioned above minimizes the axial deformation of the slug 6 (6'), and the radial pressure component p ($p \leqq P$) radially expands the cylindrical body 9 (9') of the slug 6 (6') to eliminate the gap 11 between the barrel bore 50 and the slug 6 (6'), so that the outer peripheral surface of the slug 6 (6') is in close contact with the inner surface of the barrel bore 50.

The portion of the cylindrical body 9 (9') of the slug 6 (6') in the vicinity of the rear end face 23 (23') thereof is expanded to have a circular cross section when the plunger 14 (14A) is pressed in the cavity 8 of the slug 6 (6'), so that the circular cross sectional shape of the cylindrical body is maintained by the rigidity of the plunger 14 (14'). The cylindrical body 9 (9') is brought into close contact with the inner surface of the barrel bore 50. This action by the plunger 14 in addition to the internal pressure mentioned above, prevents a buckling of the slug 6 (6'), and thus the shape of the slug 6 (6') remains symmetrical to the axis thereof. As can be understood from the foregoing, according to the present invention, the correct posture of the slug assembly is automatically maintained by the stabilizer assisted by the force derived from the propellant gas.

The explosion pressure causes the flange 15 of the stabilizer 13 (13A) to be deflected forward, so that the tapered surface 18 thereof is in close contact with the rear end face 23 (23') of the slug 6 (6') when the slug 6 (6') is fired from the muzzle of the barrel 12.

As can be seen from the foregoing, according to the present invention, the posture of the slug assembly 6 (6') when fired from the muzzle of the barrel 12 is maintained so that the axis of the slug assembly is in line with the axis of the barrel 12. After the slug assembly is fired from the muzzle of the barrel 12, the flange 15 returns to the initial state thereof due to the good elasticity thereof. The slits 19 provided in the flange 15 contribute to a uniform and quick recovery of the posture of the flange 15.

FIG. 4 shows how the posture of the slug assembly, which is inclined from the line of sight 0—0 during the flight thereof after leaving the muzzle of the barrel 12, can be restored to the initial state thereof. Note that the illustration of the inclination is exaggerated for clarity. In FIG. 4, the axis X—X of the slug assembly is inclined at an angle $\beta$ with respect to the line of sight 0—0. Taking a corner point 24 of the outer periphery of the flange 15 of the stabilizer 13 as an example, a relative air flow F caused by the flight of the slug assembly in the air comes into collision with the point 24, so that a restoring moment RM having an arm corresponding to a length of a line connecting the point 24 and the center of gravity G' is produced. Namely, the slug assembly can be automatically controlled by the stabilizer flange 15, so that the inclination angle immediately becomes zero. This automatic restoring function corresponds to the function of the tail planes (horizontal stabilizers) and the tail fin (vertical stabilizer) of an aircraft.

Figure 5:
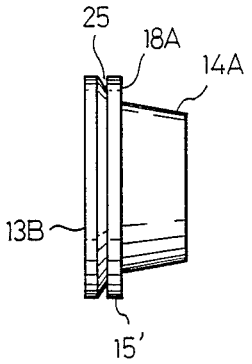
FIG. 5 is a side elevational view of a stabilizer according to another embodiment of the present invention.

FIG. 5 shows a stabilizer 13B having a flange 15' with a flat front surface 18A perpendicular to the axis thereof, as another embodiment of the present invention. on this embodiment, the flange 15' has an annular groove 25 provided on the outer periphery of the flange 15'.

The same technical effects as those provided by the stabilizer 13 or 13A can be expected from the stabilizer 13B.

A problem is raised with regard to the shape of the case 2 to be used with the slug assembly of the present invention. When the case 2 has an inner tapered surface portion 2B and the powder 3 is charged only in the tapered surface portion 2B, as shown in FIG. 8, if a circular overpowder wad 4 suitable for a case 2 with a non-tapered inner surface portion is pressed in the case 2, the overpowder wad 4 (which is usually flexible) can be easily deformed into an ellipse, so that the overpowder wad 4 tends to be seated in the case 2 at an inclination with respect to the axis of the case 2.

This inclination of the overpowder wad 4 allows a leakage of the explosion gas and produces an inclination of the end face of the filler wad 5 opposed to the overpowder wad 4, which then causes an inclination of the slug 6.

In a well known shotgun having a choked barrel, (not shown) the diameter of the barrel bore is reduced in the vicinity of the muzzle thereof, and when the slug assembly passes through the choke portion, the slug 6, which has been expanded to come into close contact with the barrel bore, as mentioned before, is contracted by the choke portion because of the low rigidity of the slug, and consequently, the outer diameter of the slug 6 is reduced. This leads to an increase of the length (FIG. 4), because of an internal pressure produced again in the cavity 8 due to the contraction of the slug 6. A component of the internal pressure acting rearward acts on the stabilizer 13 and forces the stabilizer 13 out of the cavity 8 of the slug 6. This action is referred to hereinafter as function A.

Furthermore, since the diameter of the flange 15 of the stabilizer 13 is substantially identical to the diameter of the barrel bore, as mentioned before, a slide resistance to the forward movement of the slug assembly occurs at the choked portion. This is referred to hereinafter as function B.

In addition to the foregoing, when the slug assembly approaches the muzzle of the barrel 12, the combustion of the powder 3 is completed, and thus the pressure produced by an adiabatic expansion of the explosion gas and acting on the stabilizer 13 becomes relatively low, and accordingly, the force moving the slug assembly forward is considerably reduced. This is referred to hereinafter as function C.

Due to the functions A, B and C mentioned above, the stabilizer is separated from the slug assembly, and thus the internal pressure from the filler 22 is decreased. This enables the slug to easily pass through the choked portion of the barrel of the shotgun.

Figure 6:
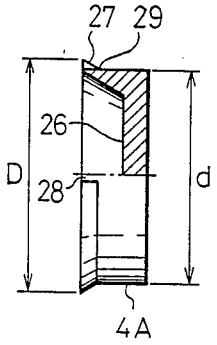
FIG. 6 is a partial sectional view of an overpowder wad which can be used with both a tapered and a non-tapered case.
Figure 7:
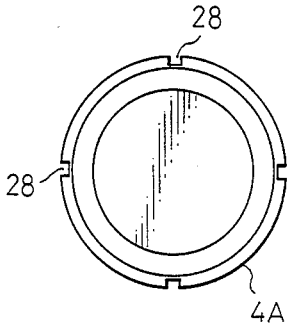
FIG. 7 is a rear view of FIG. 6.

FIGS. 6 and 7 show an example of an overpowder wad 4A which can be commonly used for both the tapered case and the non-tapered case of a shotgun shell. The overpowder wad 4A is made of a flexible or elastic material, such as plastics or the like, and has a recess 26 facing the powder 3 (FIG. 8). The overpowder wad 4A is provided, on the outer surface thereof, with a tapered projection 27 having a diameter which increases toward the end thereof adjacent to the powder. The largest diameter D of the tapered projection 27 at the extremity of the end thereof adjacent to the powder is substantially equal to the inner diameter of the case 2.

The diameter d of the cylindrical body of the overpowder wad 4A is substantially identical to the diameter of the portion of the inner tapered portion 2B (FIG. 8) of the case 2 in which the overpowder wad 4A is seated. The tapered projection 27 has a plurality of axial slits 28.

When the overpowder wad 4A is pressed in the tapered wall case, the slots 28 are contracted to decrease the diameter of the tapered projection 27, so that the overpowder wad 4A can be firmly seated in the tapered wall portion 2B of the case 2 and the plane of the overpowder wad 4A kept normal to the axis of the case 2.

When the overpowder wad 4A is fitted in the non-tapered wall case 2, the overpowder wad 4A which has the tapered projection 27 having the outer diameter D substantially equal to the inner diameter of the case 2 is radially expanded by the explosion gas, so that the outer peripheral portion 29 of the overpowder wad 4A not having the slot 28 is brought into press contact with the inner wall of the barrel bore, resulting in a prevention of a leakage of the explosive gas. This overpowder wad 4A shown in FIGS. 6 and 7 was disclosed by the present inventor in the "Journal of Technical Disclosure" published by JAPIO (Japan Patent Information Organization) on Sept. 21, 1987.

I claim:

1. A slug assembly for a shotgun shotshell having a case with opening, wherein a powder, wad or wads and the slug assembly are charged, in this order, in the case, and the opening of the case is crimped, wherein the slug assembly comprises a metal slug which is provided with a center axial cavity opening at the rear end thereof, an elastically deformable stabilizer which is provided with a plunger having a portion with a diameter larger than a diameter of the rear opening of the cavity of the slug and an annular flange having a diameter substantially identical to a diameter of a barrel bore of a shotgun in which said slug assembly is to be used, said plunger and said annular flange being coaxial to each other, a predetermined amount of filler which is charged in said cavity of the slug, and positioning means defined by the plunger and the cavity of the slug for maintaining a distance between a rear end face of the slug and a front end face of the annular flange of the stabilizer at a predetermined value, said stabilizer being fitted into the cavity of the slug so that the opening of the cavity is closed by said positioning means said plunger being axially pressed in the cavity having the predetermined amount of filler charged therein to cause an internal pressure in the cavity when the explosion of the powder takes place.

2. A slug assembly according to claim 1, wherein said flange of the stabilizer is provided, on the outer peripheral surface thereof, with a plurality of axial slits.

3. A slug assembly according to claim 1, wherein said positioning means comprises a tapered surface portion provided on the plunger which comes into contact with the cavity of the slug when the stabilizer is fitted in the cavity.

4. A slug assembly according to claim 1, wherein said positioning means comprises a stepped portion provided on the plunger to come into contat with the slug when the stabilizer is fitted in the cavity of the slug.

* * * * *